US005819416A

United States Patent [19]

Robinson et al.

[11] Patent Number: 5,819,416

[45] Date of Patent: Oct. 13, 1998

[54] SCISSORS

[75] Inventors: Victor T. Robinson, Menlo Park; C. Martin Smith, Los Angeles; Michael Butt, Menlo Park, all of Calif.; Thomas M. Aslin, Hilliard, Ohio

[73] Assignee: Elmer's Products, Inc., Columbus, Ohio

[21] Appl. No.: 723,235

[22] Filed: Sep. 27, 1996

[51] Int. Cl.[6] ..... B26B 13/20

[52] U.S. Cl. ..... 30/257; 30/271; 30/341

[58] Field of Search ..... 30/257, 340, 341, 30/254; D8/57

[56] References Cited

U.S. PATENT DOCUMENTS

| | | | |
|---|---|---|---|
| D. 251,701 | 5/1979 | Hayashi . | |
| D. 259,325 | 5/1981 | Okada . | |
| D. 316,802 | 5/1991 | Yamagishi . | |
| 342,380 | 5/1886 | Orahood | 30/257 |
| D. 344,225 | 2/1994 | Hendon et al. . | |
| D. 350,466 | 9/1994 | Ramsey et al. . | |
| D. 353,087 | 12/1994 | Ramsey et al. . | |
| 1,317,041 | 9/1919 | Scott | 30/341 |
| 2,776,482 | 1/1957 | Aafekost . | |
| 2,852,846 | 9/1958 | Ahlbin | 30/341 |
| 4,074,430 | 2/1978 | Sugiyama . | |
| 4,635,363 | 1/1987 | Chapin | 30/341 |
| 4,715,122 | 12/1987 | Lindén . | |

FOREIGN PATENT DOCUMENTS

| | | | |
|---|---|---|---|
| 2249577 | 10/1972 | Germany . | |
| 13866 | 6/1911 | United Kingdom | 30/271 |
| 1-442-620 | 7/1976 | United Kingdom | 30/254 |
| 93/06977 | 4/1993 | WIPO | 30/341 |

*Primary Examiner*—Hwei-Siu Payer

*Attorney, Agent, or Firm*—Stevens, Davis, Miller & Mosher, L.L.P.

[57] ABSTRACT

Scissors are provided having a contoured shape which allows for easy parallel surface cutting and having elastomeric, e.g., rubber, linings inserted into the finger holes of the handles of the scissors to reduce hand fatigue. These scissors are especially useful as children scissors.

21 Claims, 2 Drawing Sheets

SCISSORS

BACKGROUND OF THE INVENTION

1. Field of the Invention

The present invention relates to contoured scissors having a cushioned pair of finger holes. The scissors of the present invention, because of their contour and the cushion which lines the finger holes, result in less fatigue for the user. More particularly the present invention relates to children's scissors designed for ease of use by children.

2. Background Discussion

It is well known in the art to cut various materials with scissors. The scissors are characterized by having two pivotally attached members each member having a blade portion and a handle portion. The blades have opposed sharp edges so that the scissors can cut materials as desired. The handle portion of the scissors are typically provided with finger holes, respectively. The finger holes are often made of the same material, commonly metal, as the remainder of the handles. Common scissors result in user fatigue when employed for long periods of time. This is especially a problem for children using such scissors. It would be desirable to design scissors which are comfortable to hold and to use and thus result in less user fatigue.

SUMMARY OF THE INVENTION

It is an object of the present invention to provide scissors having finger holes which are lined.

It is another object of the present invention to provide contoured scissors having lined finger holes to reduce user fatigue.

It is another object of the present invention to provide children's scissors resulting in less fatigue by the children.

The present invention provides a scissors comprising a first member and a second member. The first member is pivotally attached to the second member and the first member is longer than the second member. The first member comprises a first handle having a proximal portion and a distal portion relative to a user. A first blade extends from the first handle distal portion. The first handle proximal portion defines a first finger hole, and an elastomeric inserted lining, having a preferred Shore A hardness of about 20 to about 80, preferably a Shore A hardness of about 30 to about 70, is attached to the first finger hole to line an inner wall of the first finger hole. The second member comprises a second handle having a proximal portion and a distal portion. A second blade extends from the second handle distal portion, the second handle proximal portion defines a second finger hole. An elastomeric lining, having a preferred Shore A hardness of about 20 to about 80, preferably a Shore A hardness of about 30 to about 70, is inserted into the second finger hole to line an inner wall of the second finger hole. The linings can be inserted into the finger holes and attached by gluing or other conventional bonding methods. The linings may even be provided with an outer perimeter having male extension for fitting a female groove in the finger holes inner perimeter or vice versa.

The scissors of the present invention are especially comfortable as children's scissors. These and other advantages will be apparent from the following discussion.

DETAILED DESCRIPTION OF THE PREFERRED EMBODIMENTS

Figure 1:
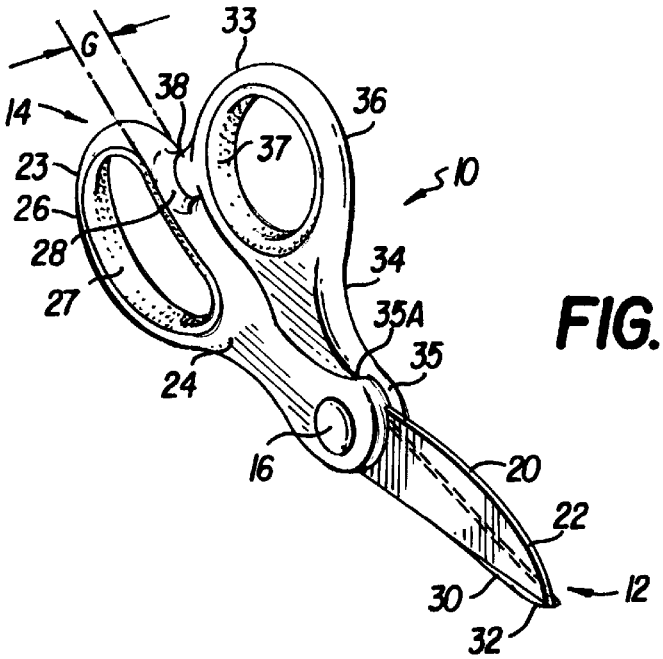
FIG. 1 shows a perspective view of an embodiment of scissors of the present invention in a closed position.

A typical preferred embodiment of the present invention is shown by FIG. 1. FIG. 1 shows scissors 10 in a closed position. Scissors 10 have a distal end 12 and proximal end 14 relative to the hand of the scissor user (not shown) which grips the scissors 10. The scissors 10 include a first member 20 and a second member 30. The first member 20 has a first handle 23, a proximal portion 24 and a distal portion 25. A first blade 22, having on edge 29, extends from the first handle distal portion 25. The first handle proximal portion 24 defines a first finger hole 26. A lining 27 is attached to the first finger hole 26 to line the entire inner surface of the finger hole 26. The lining 27 is made of an elastomeric material. Preferably the elastomeric material has a Shore A hardness of about 20 to about 80, preferably about 30 to about 70. Typical elastomeric materials include polyurethane foam, polystyrene, rubber or other known pliable elastomeric materials. The elastomeric material being deformable upon exertion of finger pressure and returning to its original shape upon release of the finger pressure. The first handle 23 is also provided with a first stop 28.

The second member 30 comprises a second handle 33 having a proximal portion 34 and a distal portion 35. A second blade 32, having an edge 29, extends from the second handle distal portion 35. The second handle proximal portion 34 defines a second finger hole 36. The inner surface of the second finger hole 36 is lined with a second elastomeric lining 37. The first and second elastomeric linings 27, 37 are typically made of the same materials. The second handle 33 is also provided with a second stop 38. First and second stops 28, 38 protrude from their respective handles 23, 33 and contact each other when the scissors are closed as shown in FIGS. 1 and 2 and define a gap 50.

Figure 2:
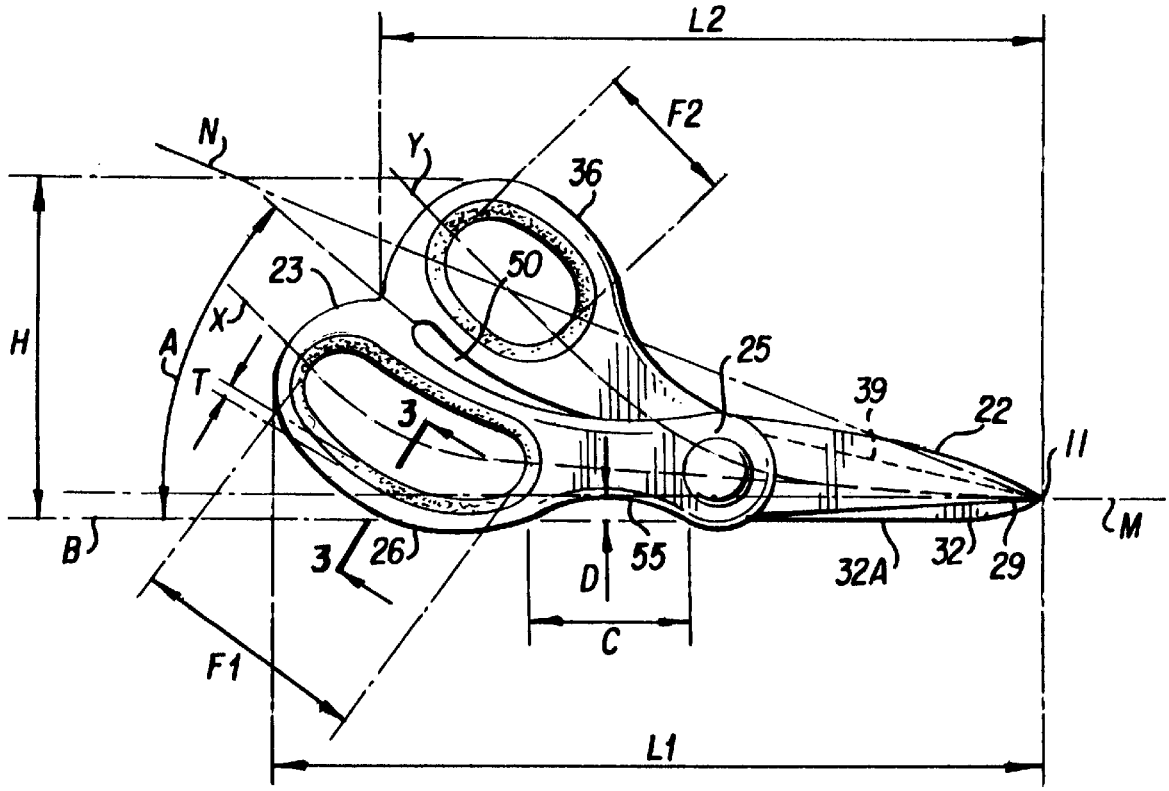
FIG. 2 shows a side view of the scissors of FIG. 1.

The embodiment of the scissors 10 of the present invention shown by FIGS. 1 and 2 has a curved contour (scoop) shape. A curved contour is defined as a shape in which the central axis "X" and central axis "Y" of the members 20, 30, respectively (see FIG. 2) are continuous curves rather than having an abrupt angle. As shown in FIG. 2 the respective curved central axis X, Y lack an inflection point. For example, as shown by FIG. 2, and angle is formed by the intersection of the line N and line M at the distal end 11 of the scissors 10. Line N is a line from a first point of curved central axis Y to the distal end 11 of the scissors 10. Line M is a longitudinal line parallel to the baseline B. If any second point of central curved axis Y is selected and this second point is closer to the distal end 11 than is the first point, and another angle (not shown) is formed by the intersection at the distal end of the longitudinal line M and a line (not shown) from this second point to the distal end 11, then this would form a smaller angle than that formed by line M and line N. This contour shape allows for easy parallel-surface cutting by allowing the blades to glide on a table surface (not shown) upon which a material to be cut is located. With conventional children scissors, the child has to pick up the scissors to cut the object. Otherwise, the handle will press against the table and the child will not be able to open the scissors. However, with the scissors 10 of the present invention, the handles 23, 33 can be opened and closed while a lower side 32A of the second blade 32 is cutting on the table surface (not shown). As shown in FIG. 2, the point where handles 23, 33 meet formed an angle "A" with a base line "B" of the blades 32 of from about 22° to about 32°, preferably, about 25° to about 30°. This angle is achieved in part by having the first member 20 being longer than the second member 30. Typically, the first member 20 has a length of L1 of about 5 to about 8 inches. However, for children's scissors it is preferred to have a length of about 5 to about 6 inches, preferably about 5 to about 5.5 inches. The second member has a length L2 which is about 0.5 to about 1 inches shorter than the first member. However, for children's scissors, the second member 30 is about 0.5 to about 0.75 inches shorter than the first member 20. As seen in FIG. 2, the first member 20 has a curved first central axis "X"and the second member 30 has a curved second central axis "Y". Axis "X" and axis "Y" are curvlinear longitudinal lines for each member 20, 30. FIG. 2 shows axis "X" and axis "Y" passing through the pivot 16 and meeting at the distal end of the blades 22 and 32.

Figure 4:
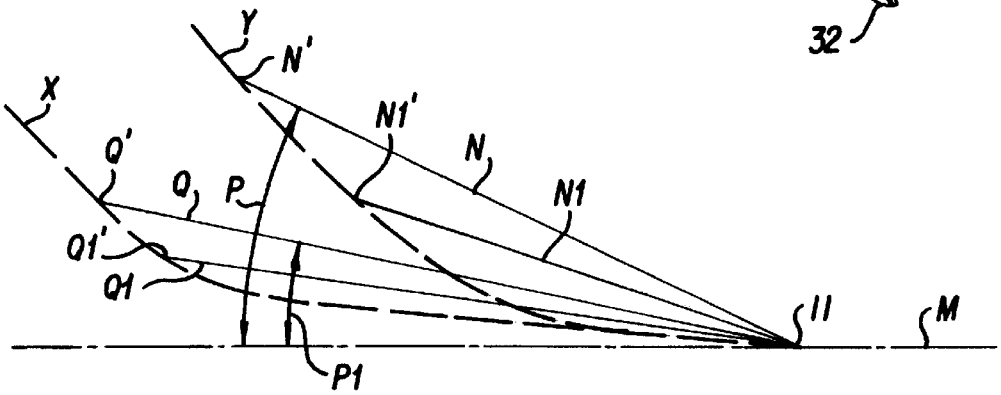
FIG. 4 shows angles formed by the intersection of lines drawn from a distal end of scissors of FIG. 3 with curved central axes of the scissors and a horizontal line passing through the distal end of the scissors.

FIG. 4 angles, e.g., P, P1, formed by the intersection of lines N, Q respectively and a horizontal line M passing through the distal end 11 of the scissors 10. Lines N, Q are drawn from the distal end 11 of the scissors 10 of FIG. 2 to the respective points N', Q' of the curved axes Y, X of the scissors 10. The respective angles formed by intersection of line M and respective lines, e.g., lines N1, Q1, drawn from any points, e., points N1', Q1', of the axes Y, X which are respectively closer to the distal end 11 of the scissors are smaller than angles P, P1, respectively.

To further facilitate use, the first member 20 has a contoured indentation 55. Indentation 55 has a length "C" and a depth "D" as shown on FIG. 2. Typically, the contour has a length "C" of about 0.75 to about 1.5 inches and a depth "D" of about 0.25 to about 0.5 inches relative to baseline "B". Typically for children's scissors, the contour has a length "C" of about 0.75 to about 1 inches. As shown in FIG. 1, members 20, 30 are pivotally attached by a pivot 16 at their respective distal portions 25, 35.

First finger hole 26 has a length "F1" and second finger hole 36 has a length "F2". First finger hole 26 is designed to hold two or more fingers and accordingly has a length "F1" of about 1.25 to about 2 inches long. However, for children scissors, the first finger hole 26 has a length "F 1" of about 1.25 to about 2 inches long. The second finger hole has a length "F2" of about 1 to about 1.5 inches long, and for children scissors, preferably about 1 to about 1.25 inches long. The second finger hole 36 is designed to accommodate a thumb (not shown). Generally, the scissors 10 have a height "H" as shown on FIG. 2. Height "H" typically ranges from about 2 to about 3.25 inches. Height "H" typically ranges from about 2.25 to about 2.5 inches for children's scissors.

The blades 22, 32 are made of metal or other conventional cutting material. The handles 23, 33 are also made of metal or plastic. The blades 22, 32 may be one piece with their respective handles 23, 33 or the blades 22, 32 may be attached to their respective handles 23, 33.

Figure 1A:
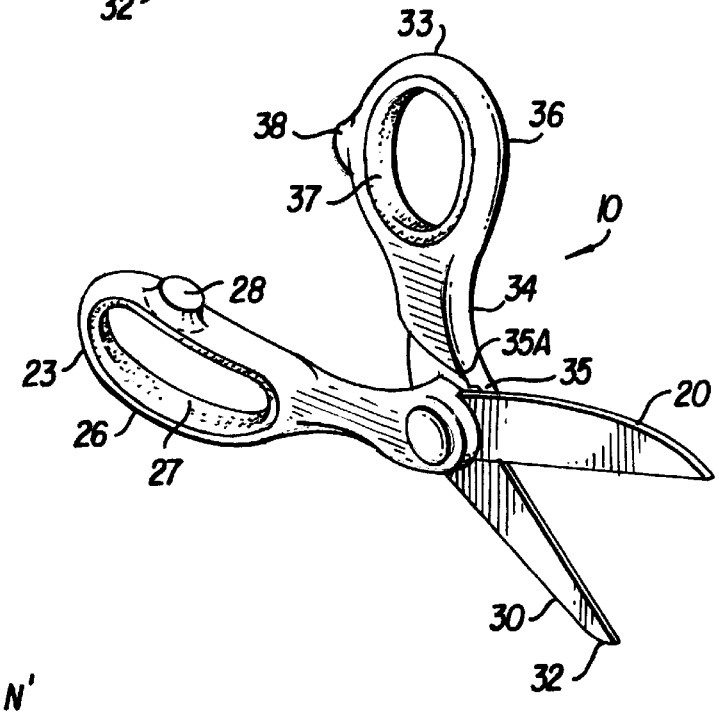
FIG. 1A shows a perspective view of the scissors of FIG. 1 in an open position.

Also, as shown in FIGS. 1 and 1A, second member 30 has a ridge 35A. Upon opening, ridge 35A contacts first member 20 to restrict the amount of opening of the members 20, 30.

The finger hole insert linings 27, 37 have a thickness "T" as seen on FIG. 2. The thickness "T" typically ranges from about 0.075 to about 0.25 inches thick. The insert linings 27, 37 also have a width "W" of at most about the same as that of the finger holes 26, 36.

Figure 3:
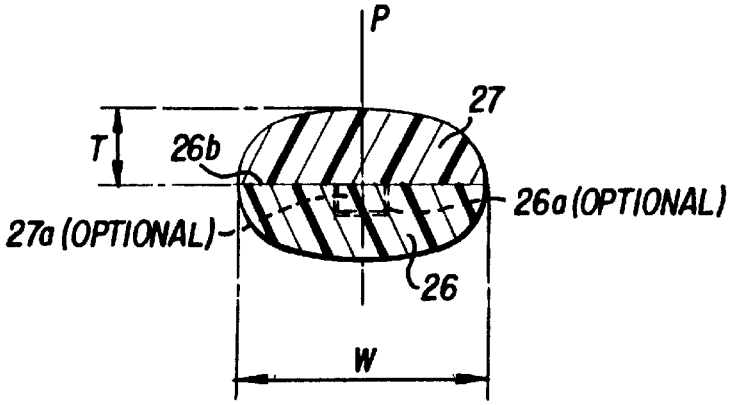
FIG. 3 shows a cross sectional view of a portion of a finger hole of the embodiment of FIG. 2.

In the preferred embodiment shown by FIG. 1, the handles 23, 33 are entirely made of metal, polymeric material (plastic), or metal coated with polymeric material. The polymeric coating may or may not be the same of that of the elastomeric material for the insert linings 27, 37. Preferably, the polymeric material on the surface of the handles 23, 33 is selected from the group consisting of soft natural or man-made elastomeric materials such as rubber or thermoplastics. Typical man-made materials include polyurethane, polyolefins, styrenic elastomer or polyvinyl chloride. Preferably, as shown in FIG. 1, the finger holes 26, 36 and their respective insert linings 27, 37 have a width "G" of about 0.35 to about 0.5 inches. This wide thickness "G" makes the scissors more comfortable by allowing the user to exert pressure over a wider surface area rather than concentrating pressure on a narrow edge as typical of many children scissors. The insert linings 27, 37 are glued or otherwise bonded to inner walls of the finger holes 26, 36. The insert linings 27, 37 may have optional male extensions that fit into an optional groove of the inside walls of the finger holes. FIG. 3 shows an optional male extension 27*a* and optional female groove 26*a*.

FIG. 3 also shows an inner wall 26*b* of the finger hole 26 of the first handle 23 and a portion of a phantom longitudinal plane P. The entire plane P (not shown) would pass centrally through both holes 26, 36. Thus, as FIG. 3 shows, the inner wall 26*b*, about the finger hole 26, and insert 27, attached to the inner wall 26*b*, are symmetrical transversely about plane P. Likewise, and inner wall of the second handle 33 about thumb hole 36 and its insert 37 are also symmetrical about the plane P. Thus, the scissors 10 are ambidextrous.

The present scissors have numerous advantageous. As discussed above, the handles are bent in a smooth contoured form. With the scissors of the present invention, the handles can be opened and closed while the bottom blade is cutting on a table surface. This differs from conventional straight or sharply angled scissors and is especially helpful for children. With conventional children's scissors, the child has to pick up the scissors to cut the object. Otherwise, the handle will press against the table and the child will not be able to open the scissors.

Also, the handles are designed to fit little hands in the most preferred embodiments. For instance, the bottom handle has the contour indentation lined with plastic which allows children to comfortably place their fore finger on the plastic handle underside rather than on the actual blade steel. Also, the handles are made to have a rubbery material insert lining in the finger holes and preferably on the remainder of the surface of the handles. This may delay hand fatigue which is typical among young children cutting with the scissors.

In view of the above, it should be apparent that many modifications may be made to the above-described embodiments and still come within the scope of the present invention. Thus, the present invention is not limited by the above-described embodiments but is defined by the claims appended hereto.

What is claimed is:

1. A scissors comprising a first member and a second member, the first member pivotally attached at a pivot point to the second member, the first member being longer than the second member;

the first member comprising a first handle having a proximal portion and a distal portion relative to a user, and a first blade extending from said first handle distal portion, said first handle and said first blade having a first central axis, said first handle proximal portion defining a finger hole, an elastomeric lining attached to the first handle to line the finger hole; and the second member comprising a second handle having a proximal portion and a distal portion relative to a user, a second blade extending from said second handle distal portion, said second handle and said second blade having a second central axis, said second handle proximal portion having an inner wall and defining a thumb hole, and having an elastomeric lining attached to said second handle inner wall to line the thumb hole, wherein the respective central axes of the first and second members are curved, and the second blade defines a baseline of the scissors, wherein the second blade has an edge and a lower side, the baseline being aligned with said lower side of said second blade and passes through a portion of said first handle below the finger hole when said scissors are in a closed position, wherein each of the curved central axes lack an inflection point.

2. The scissors of claim 1, wherein the first member and the second member have respective curved contour shapes.

3. The scissors of claim 2, wherein the height of the scissors ranges from about 2 to about 3 inches.

4. The scissors of claim 2, wherein the height of the scissors ranges from about 2.125 to about 2.5 inches.

5. The scissors of claim 1, wherein the finger hole is about 1.25 to about 2.5 inches long and the thumb hole is about 1 to about 1.5 inches long.

6. The scissors of claim 1, wherein each elastomeric lining is about 0.075 to about 0.25 inches thick and has a Shore A hardness of about 30 to about 70.

7. The scissors of claim 1, wherein the angle of the second handle relative to the baseline of the second blade is about 22° to about 32°.

8. The scissors of claim 1, wherein the angle of the second handle relative to the baseline of the second blade is about 25° to about 30°.

9. The scissors of claim 1, wherein the first handle has an outside wall transverse to a longitudinal plane of the scissors, the outside wall defines a contoured indentation between the finger hole and the first handle distal portion.

10. The scissors of claim 9, wherein the contoured indentation being about 0.25 to about 0.5 inches deep relative to the baseline of the second blade.

11. The scissors of claim 10, wherein the contoured indentation has a length of about 0.75 to 1.5 inches.

12. The scissors of claim 11, wherein the first member has a length of about 5 to about 5.5 inches and the second member is about 0.5 to about 0.75 inches shorter than the first member, the height of the scissors range from about 2.125 to 2.5 inches, and the width (W) of the finger hole and the thumb hole ranges from about 0.35 to about 0.5 inches.

13. The scissors of claim 9, wherein the contoured indentation of said first handle has a depth relative to said baseline.

14. The scissors of claim 1, wherein the first member has a length of about 5 to about 8 inches and the second member is about 0.5 to about 1 inches shorter than the first member.

15. The scissors of claim 1, wherein the first member has a length of about 5 to about 6 inches and the second member is about 0.5 to about 1 inches shorter than the first member.

16. The scissors of claim 1, wherein the first member has a length of about 5 to about 5.5 inches and the second member is about 0.5 to about 0.75 inches shorter than the first member.

17. The scissors of claim 16, wherein the height of the scissors ranges from about 2.125 to about 2.5 inches, wherein the first handle has an outside wall transverse to a longitudinal plane of the scissors, wherein the outside wall defines a contoured indentation between the finger hole and the first handle distal portion, wherein the contoured indentation is about 0.25 to 0.5 inches deep relative to the baseline of the second blade, and the contoured indentation has a length of about 0.75 to 1 inches.

18. The scissors of claim 1, wherein the first handle has an inner wall, wherein the scissors are ambidextrous, wherein a longitudinal plane (P) passing centrally through both said first handle inner wall and said second handle inner wall, said first handle inner wall defining the scissors finger hole is symmetrical transverse to the longitudinal plane (P), and the second handle inner wall defining the scissors thumb hole is symmetrical transverse to said longitudinal plane (P).

19. The scissors of claim 1, wherein the scissors have a distal end, wherein for each curved central axis, a set of respective angles is formed by a set of respective lines, from points of each curved central axis to the distal end of the scissors, which intersect a longitudinal line parallel to the baseline and passing through the distal end of the scissors, wherein for each said axis, each angle, which respectively includes a first said point of one the curved axes, is larger than each angle which respectively includes any second said point of the same axis which is closer to the distal end of the scissors than said first point.

20. The scissors of claim 1, wherein the width of the elastomeric linings is at most equal to the width of the respective finger hole and thumb hole.

21. The scissors of claim 1, wherein the second member has a ridge, at the distal portion of the second handle, for restricting the amount of opening of the members by contacting the first member when the scissors are in an open position.

* * * * *